US007721391B2

(12) United States Patent
Bukovitz et al.

(10) Patent No.: US 7,721,391 B2
(45) Date of Patent: May 25, 2010

(54) QUICK RELEASE LOCK MECHANISMS FOR HANDLE EXTENSIONS

(75) Inventors: Richard K. Bukovitz, Orrville, OH (US); John L. Scott, Sr., Wooster, OH (US); Michael L. Zimmerman, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 210 days.

(21) Appl. No.: 11/746,735

(22) Filed: May 10, 2007

(65) Prior Publication Data

US 2008/0276429 A1 Nov. 13, 2008

(51) Int. Cl.
*B25G 1/04* (2006.01)

(52) U.S. Cl. ..... 16/429; 16/405; 16/436; 16/427; 15/145

(58) Field of Classification Search ..... 16/429, 16/405, 436, 900, 427; 15/145, 146; 403/321, 403/322.1, 322.3, 322.4, 325, 359.1, 359.6, 403/345, 359.5, 327, 330, 324; 81/397, 177.2, 81/177.85; 411/418
See application file for complete search history.

(56) References Cited

U.S. PATENT DOCUMENTS

| | | | | | |
|---|---|---|---|---|---|
| 1,465,148 | A * | 8/1923 | Rosenberg | 411/418 |
| 2,043,598 | A | 6/1936 | Subia | |
| 3,596,946 | A * | 8/1971 | Burton et al. | 403/109.5 |
| 3,625,548 | A * | 12/1971 | Boehm | 285/27 |
| 4,373,828 | A | 2/1983 | Sartori | |
| 4,406,559 | A * | 9/1983 | Geertsema et al. | 403/287 |
| 4,541,139 | A | 9/1985 | Jones et al. | |
| 4,642,837 | A | 2/1987 | Nichols et al. | |
| 4,786,095 | A * | 11/1988 | Dumont | 294/51 |
| 5,083,338 | A * | 1/1992 | Unger | 15/121 |
| 5,288,161 | A | 2/1994 | Graves et al. | |
| 5,385,420 | A * | 1/1995 | Newman et al. | 403/299 |
| 5,980,177 | A * | 11/1999 | Schiess et al. | 411/299 |
| 6,254,303 | B1 * | 7/2001 | Falat et al. | 403/348 |
| 6,425,705 | B1 * | 7/2002 | Ingram | 401/290 |
| 6,671,930 | B2 | 1/2004 | Lanz | |
| 2002/0026686 | A1 * | 3/2002 | Newman et al. | 16/427 |
| 2002/0131843 | A1 * | 9/2002 | Chen-Chi et al. | 411/418 |

* cited by examiner

*Primary Examiner*—Robert J Sandy
*Assistant Examiner*—Jeffrey O'Brien
(74) *Attorney, Agent, or Firm*—Renner, Otto, Boiselle & Sklar, LLP

(57) ABSTRACT

Locking mechanisms for releasably connecting handle extensions to tool handles having either compatible lock engaging end portions or standard internally threaded sockets include an adaptor mounted on an outboard end of a handle extension, the adaptor including an extension pole tip with circumferentially spaced thread segments axially insertable into tool handle sockets having compatible lock engaging end portions and threadably connectable to tool handles having standard internally threaded sockets. Means are provided for preventing relative rotation between the adaptor and tool handles having compatible lock engaging end portions when the extension pole tip is fully inserted into the tool handle sockets and for preventing inadvertent pull out of the extension pole tip from the tool handle sockets.

20 Claims, 7 Drawing Sheets

QUICK RELEASE LOCK MECHANISMS FOR HANDLE EXTENSIONS

FIELD OF THE INVENTION

This invention relates to quick release lock mechanisms for releasably connecting handle extensions to tool handles having both compatible and standard tool handle sockets.

BACKGROUND OF THE INVENTION

It is generally known to provide handle extensions with quick release lock mechanisms that allow for the quick and easy attachment (and removal) of the handle extensions to (and from) tool handles having compatible lock engaging end portions. However, such quick release lock mechanisms have the objection that they cannot readily be used with tool handles having standard internally threaded sockets unless an appropriate adaptor configured to mate with the quick release lock mechanisms is first threaded into the tool handle sockets. Also there is the potential that the operator/user of such handle extensions may not be aware of the availability of such an adaptor, or even if so aware, the adaptor may be lost or misplaced when the operator/user wants to use it.

SUMMARY OF THE INVENTION

The present invention relates to quick release lock mechanisms for releasably connecting handle extensions to tool handles having either compatible lock engaging end portions or standard internally threaded sockets.

In accordance with one aspect of the invention, the quick release lock mechanisms include handle extension adaptors having extension pole tips with circumferentially spaced thread segments that are quickly and easily insertable into and removable from compatible tool handle lock engaging end portions and are also threadedly connectable to tool handles having standard internally threaded sockets.

In accordance with another aspect of the invention, the compatible tool handle lock engaging end portions may include sockets with circumferentially spaced segments having relief areas therebetween for receipt of the thread segments on the extension pole tips during insertion and removal of the extension pole tips into and out of the tool handle sockets.

In accordance with another aspect of the invention, the circumferentially spaced segments within the tool handle sockets may be thread segments that are compatible with the thread segments on the extension pole tips to allow the tool handles to be rotated a part turn relative to the handle extensions to bring the thread segments into and out of overlapping engagement with each other.

In accordance with another aspect of the invention, the quick release lock mechanisms may include locking tabs that are movable into and out of slots on the tool handle end portions when the thread segments of the quick release lock mechanisms and tool handle lock engaging end portions are in overlapping engagement with each other to selectively prevent further relative rotation therebetween.

In accordance with another aspect of the invention, a non-rotatable connection may be provided between the quick release lock mechanisms and tool handles having compatible lock engaging end portions when the extension pole tips are fully inserted into the tool handle sockets to prevent relative rotation therebetween, and releasable latches may prevent the extension pole tips from being withdrawn from the sockets until released.

In accordance with another aspect of the invention, the releasable latches may include locking members mounted for movement into and out of locking engagement with one or more lock receiving holes or recesses in the tool handle lock engaging end portions.

In accordance with another aspect of the invention, the latches may be axially movable into and out of radial alignment with at least one of the lock receiving recesses in the tool handle lock engaging end portions.

In accordance with another aspect of the invention, the tool handle lock engaging end portions may include a non-circular recess for receipt of a correspondingly shaped shoulder on the quick release lock mechanisms when the extension pole tips are fully inserted into the tool handle sockets to prevent relative rotation therebetween.

In accordance with another aspect of the invention, the quick release lock mechanisms may include a cover slide for covering the non-circular shoulder on the quick release lock mechanisms when the quick release lock mechanisms are used with tool handles having standard internally threaded sockets.

In accordance with another aspect of the invention, the cover slide may be locked in its fully extended position covering the non-circular shoulder on the quick release lock mechanisms by the locking member when the locking member is in its fully retracted position.

In accordance with another aspect of the invention, both the cover slide and the locking member may be mounted for movement independently of one another.

In accordance with another aspect of the invention, movements of both the cover slide and the locking member may be controlled by cams operated by a single rotatable sleeve.

DETAILED DESCRIPTION OF THE INVENTION

The various quick release lock mechanisms of the present invention may be used to provide for the quick and easy attachment (and removal) of handle extensions to handles or hand grips of tools such as paint rollers or other tools, to allow the operator to use the tools without the aid of a ladder. Such handle extensions may be extension poles of a fixed length or consist of two or more telescoping members adjustable to different lengths, as well known in the art. The quick release lock mechanisms of the present invention also have the advantage of being able to connect handle extensions to tool handles having standard internally threaded sockets as described hereafter.

Figure 1:
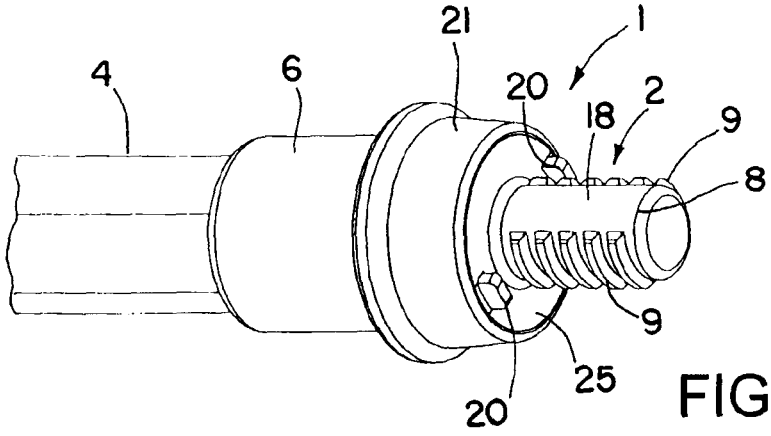
FIG. 1 is a perspective view of one form of quick release lock mechanism of the present invention shown mounted on the outboard end of a handle extension.
Figure 2:
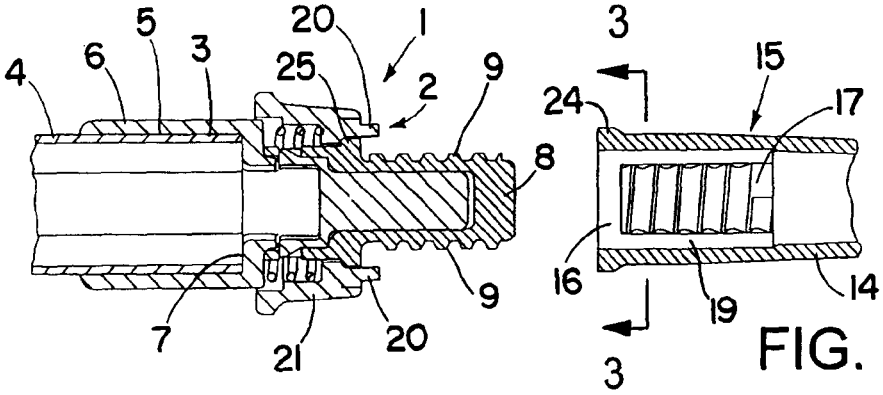
FIG. 2 is a fragmentary longitudinal section through the quick release lock mechanism of FIG. 1 and a tool handle having a compatible lock engaging end portion.

Referring now in detail to the drawings, wherein like reference numbers followed by a prime symbol (') are used to designate like parts, and initially to FIGS. 1 and 2, there is shown one form of quick release lock mechanism 1 of the present invention which includes an adaptor 2 attached to the outboard end 3 of a handle extension 4 as by providing a recess 5 in the inner end 6 of the adaptor that is sized for close sliding receipt over the outboard end of the extension pole (see FIG. 2). An internal shoulder 7 at the inner end of recess 5 limits the extent to which the adaptor may be inserted onto the handle extension. Relative rotation therebetween may be prevented as by making the overlapping surfaces of the handle extension 4 and adaptor 2 a corresponding non-cylindrical shape such as a hex shape. Also the adaptor may be secured to the handle extension in any suitable manner, for example, by providing a screw connection therebetween.

Adaptor 2 includes an axially outwardly extending rod-like extension pole tip 8 having a plurality of circumferentially spaced external thread segments 9 on the outer surface thereof to permit the quick release lock mechanism 1 to be used to threadedly connect handle extensions to tool handles having standard internally threaded sockets and to provide for the quick and easy attachment (and removal) of handle extensions to tool handles having compatible quick release lock engaging end portions as described hereafter.

Figure 3:
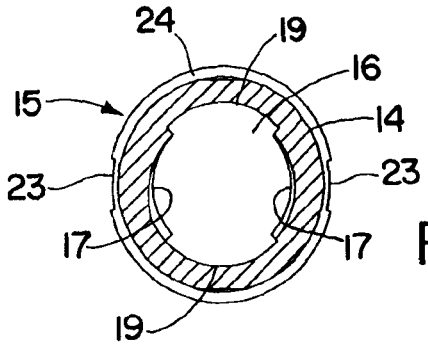
FIG. 3 is an enlarged transverse section through the tool handle lock engaging end portion of FIG. 2 taken on the plane of the line 3-3 thereof.
Figure 4:
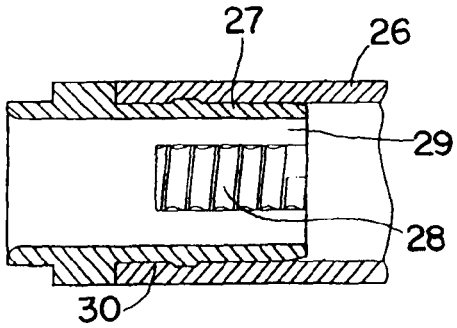
FIG. 4 is an enlarged fragmentary longitudinal section through a tool handle having a separate insert with compatible lock engaging end portion suitably mounted inside the tool handle socket.
Figure 5:
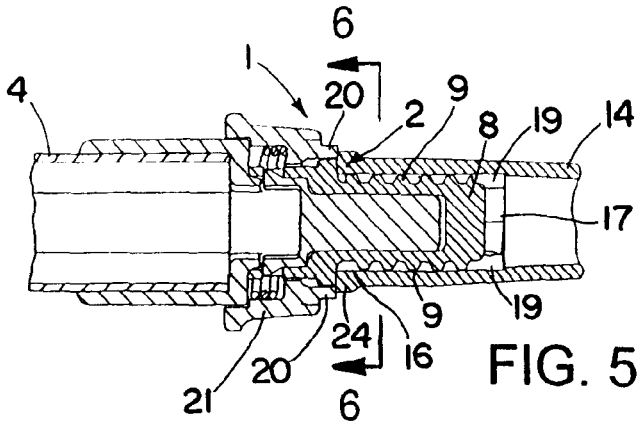
FIG. 5 is a fragmentary longitudinal section similar to FIG. 2 but showing the extension pole tip of the quick release lock mechanism inserted into the tool handle lock engaging end portion.
Figure 6:
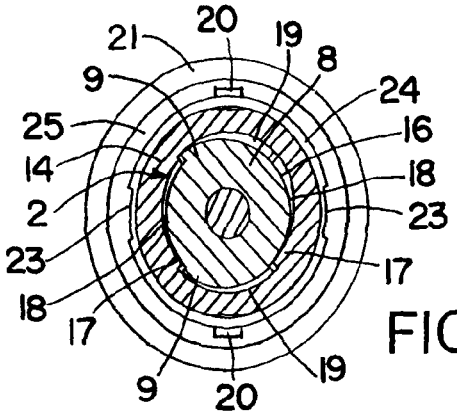
FIG. 6 is an enlarged transverse section through the assembly of FIG. 5 taken on the plane of the line 6-6 thereof.

One such tool handle 14 having a compatible quick release lock engaging end portion 15 is shown in FIGS. 2 and 3 as comprising a tool handle socket 16 having the same number of compatible internal thread segments 17 as external thread segments 9 on the extension pole tip 8. The respective thread segments 9 and 17 have sufficient relief areas 18 and 19 therebetween to accommodate the thread segments 9 and 17 on the extension pole tip 8 and tool handle socket 16 when the thread segments are out of alignment with each other to permit easy insertion of the extension pole tip into the tool handle socket 16 as shown in FIGS. 5 and 6 and removal therefrom. Two such thread segments 9 and 17 are shown on extension pole tip 8 and handle socket 16 of the embodiment shown in FIGS. 1-8. However, it will be appreciated that a corresponding greater or lesser number of thread segments may be provided on each part as desired, as long as the relief areas 18, 19 between the thread segments on the respective parts are properly sized to accommodate the thread segments on the other part when the thread segments on the respective parts are out of alignment with each other.

Figure 7:
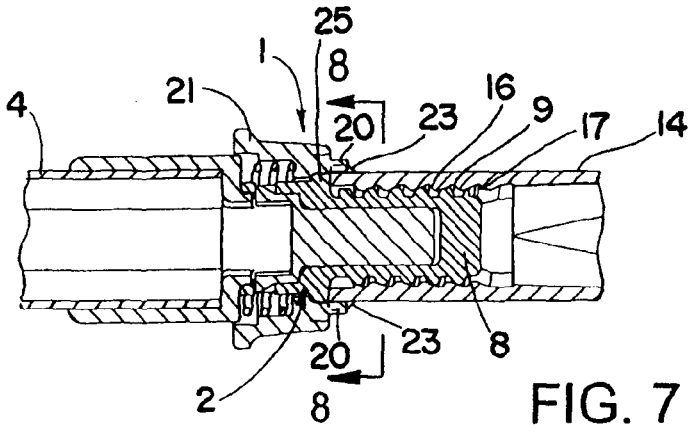
FIG. 7 is a fragmentary longitudinal section similar to FIG. 5 but showing the tool handle rotated a part turn relative to the handle extension to bring thread segments on the extension pole tip into overlapping relation with thread segments in the tool handle lock engaging end portion.
Figure 8:
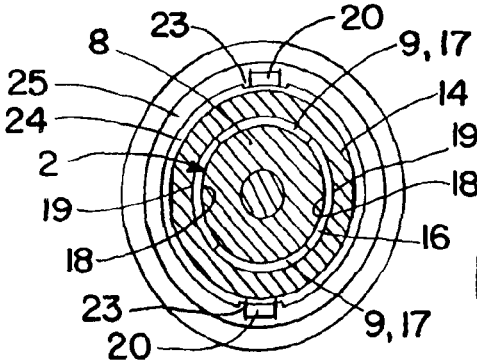
FIG. 8 is an enlarged transverse section through the assembly of FIG. 7 taken on the plane of the line 8-8 thereof.

Once the extension pole tip 8 is fully inserted into the tool handle socket 16 as shown in FIGS. 5 and 6, the tool handle 14 may be rotated a part turn relative to the handle extension 4 to cause the thread segments 9, 17 to engage and overlap one another as shown in FIGS. 7 and 8 to prevent pull out of the handle extension from the tool handle socket. Inadvertent continued relative rotation therebetween may be prevented as by providing one or more tabs 20 on a spring loaded sleeve 21 surrounding the inner end of the pole adaptor 2 that snap into correspondingly shaped slots or grooves 23 in a radial shoulder 24 at the innermost end of the tool handle 14 when the thread segments are fully engaged with one another as further shown in FIGS. 7 and 8.

To disconnect the handle extension 4 from the tool handle 14, all the operator need do is retract the spring loaded sleeve 21 to withdraw the tabs 20 from the tool handle slots 23 and rotate the tool handle 14 a part turn relative to the handle extension 4 until the thread segments 9 on the extension pole tip 8 are once again in alignment with the relief areas 19 in the tool handle socket 16 and vice versa so the extension pole tip can easily and quickly be withdrawn from the tool handle socket.

During insertion of the extension pole tip 8 into the tool handle socket 16 with the thread segments 9 and 17 out of alignment with each other, the shoulder 24 at the innermost end of the tool handle 14 pressing against the locking tabs 20 will cause the spring loaded sleeve 21 to move to the fully retracted position shown in FIGS. 5 and 6 until the tool handle is rotated a part turn relative to the handle extension to bring the locking tabs 20 into alignment with the tab engaging slots 23 in the tool handle end portion in the manner previously described.

Likewise, when the extension pole tip 8 of the quick release lock mechanism 1 is threadedly connected to a conventional tool handle having a standard internally threaded socket, the innermost end of the tool handle pressing against the locking tabs 20 will cause the locking tabs to retract whereby when the tool handle is fully tightened on the adaptor, the innermost end of the tool handle will frictionally engage an external shoulder 25 on the adaptor radially inwardly of the spring loaded sleeve for frictionally locking the tool handle against loosening.

The internal thread segments 17 are shown molded integral with the tool handle 14 in FIGS. 2, 3 and 5-8. However, if the tool handle 26 is molded hollow to a relatively large size out of a relatively inexpensive plastic such as polypropylene, a separate insert 27 containing the thread segments 28 and relief areas 29 therebetween may be snap fitted into the tool handle socket 30 as schematically shown in FIG. 4.

FIGS. 9-12 show another form of quick release lock mechanism 40 of the present invention which also includes an adaptor 41 having an axially outwardly extending rod-like extension pole tip 42 with circumferentially spaced external thread segments 43 on the outer surface thereof similar to the thread segments 9 of the quick release lock mechanism 1 shown in FIGS. 1-8 for connecting a handle extension with quick release lock mechanism 40 mounted thereon to a tool handle having a standard internally threaded socket in the manner previously described.

Figure 11:
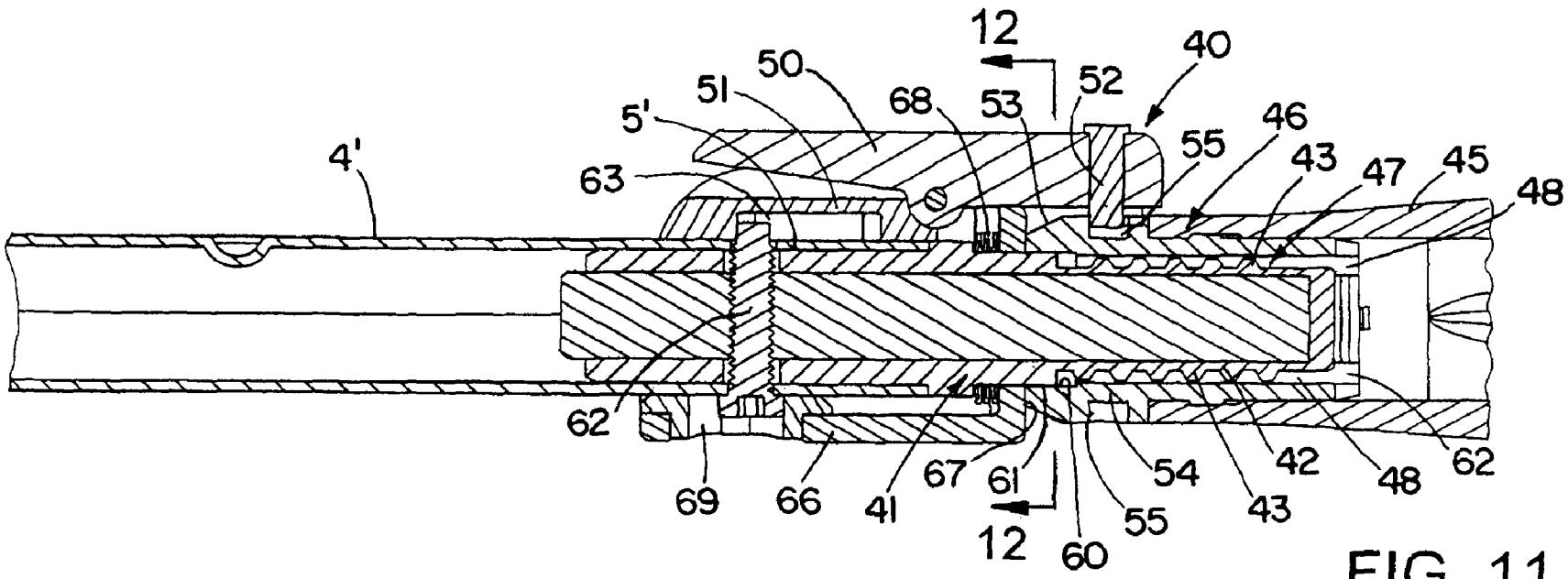
FIG. 11 is a fragmentary longitudinal section similar to FIG. 10 but showing the extension pole tip of the lock mechanism fully inserted into a compatible tool handle lock engaging end portion with the latch mechanism fully extended and the cover slide fully retracted.
Figure 12:
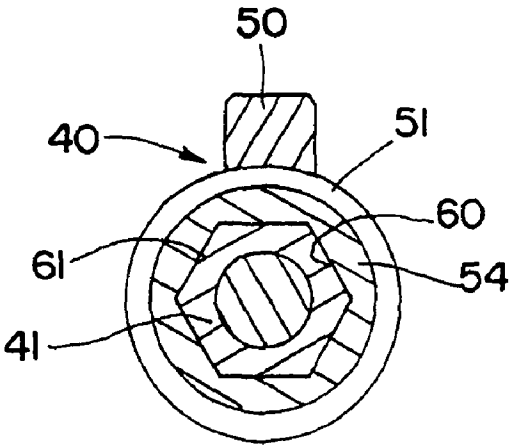
FIG. 12 is a transverse section through the assembly of FIG. 11 taken on the plane of the line 12-12 thereof.
Figure 13:
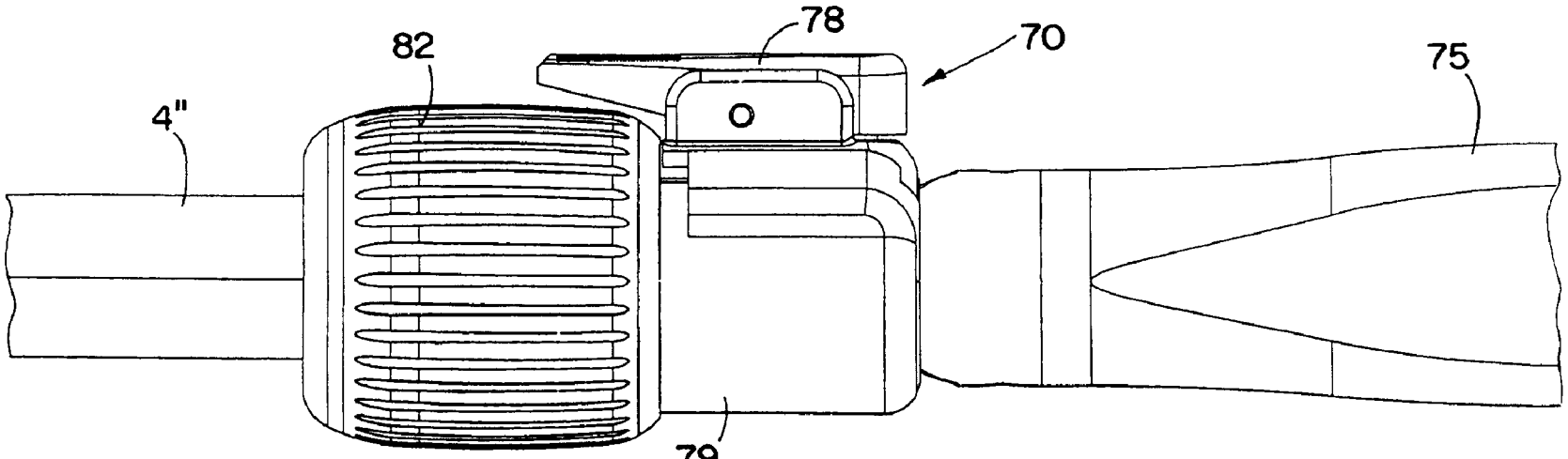
FIG. 13 is a side elevation view of another form of quick release lock mechanism of the present invention mounted on the outboard end of a handle extension, the lock mechanism including a latch member shown fully retracted and a cover slide shown fully extended.

A tool handle 45 with a lock engaging end portion 46 that is compatible with the quick release lock mechanism 40 is also shown in FIGS. 11 and 12, and includes a tool handle socket 47 having circumferentially spaced longitudinally extending slots or grooves 48 for accommodating the thread segments 43 on the extension pole tip 42 when in alignment with each other for ease of insertion of the extension pole tip into the tool handle socket as shown in FIG. 11 and removal therefrom. However, instead of providing corresponding thread segments in the tool handle socket 47 for engagement by the thread segments 43 on the extension pole tip by rotating the tool handle 45 a part turn relative to the handle extension 4' after the extension pole tip has been fully inserted into the tool handle socket to prevent withdrawal of the extension pole tip from the tool handle socket, cooperating latch members may be provided on the handle extension adaptor and tool handle to releasably retain the handle extension and tool handle together when the extension pole tip is fully inserted into the tool handle socket.

Figure 9:
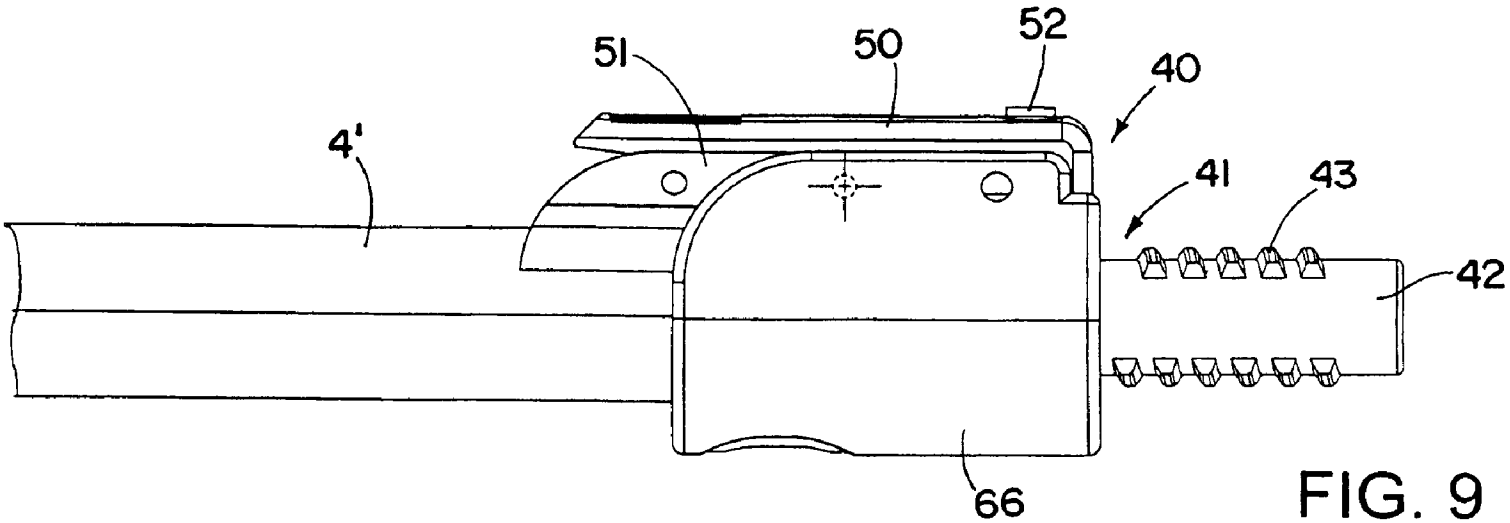
FIG. 9 is a side elevation view of another form of quick release lock mechanism of the present invention mounted on the outboard end of a handle extension, the lock mechanism including a latch mechanism shown fully retracted and a cover slide shown fully extended.
Figure 10:
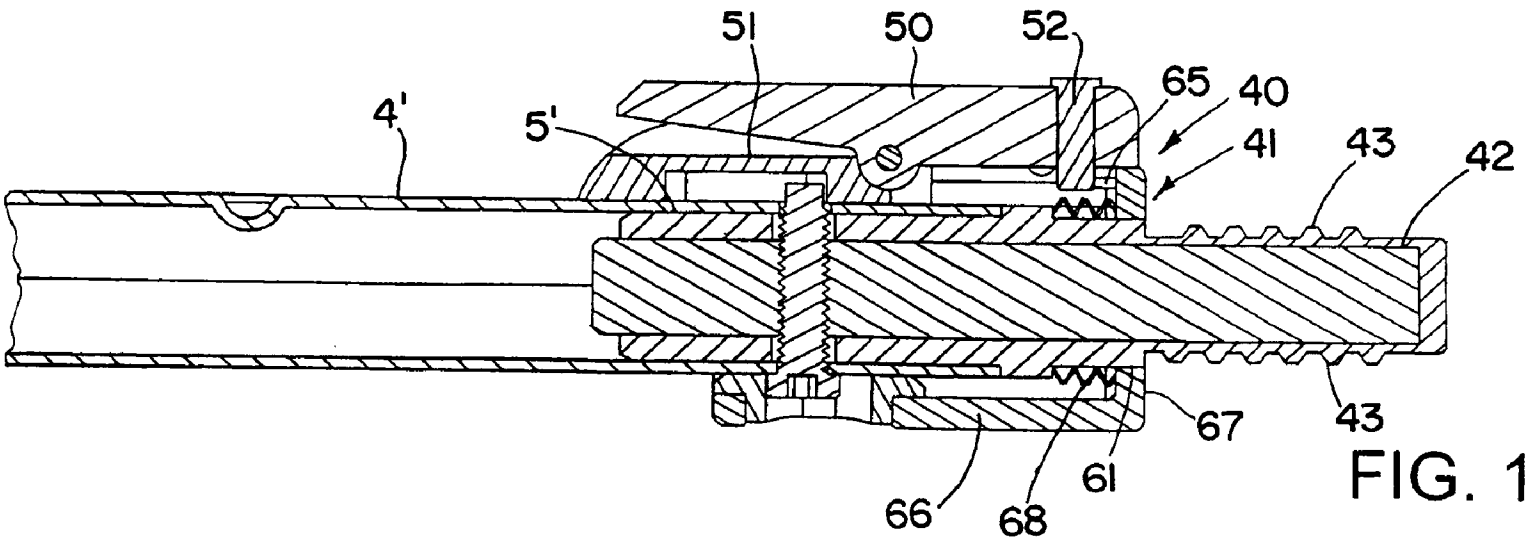
FIG. 10 is a longitudinal section through the quick release lock mechanism and handle extension outboard end of FIG. 9.

In the embodiment shown in FIGS. 9-12, the latch member of the quick release lock mechanism 40 comprises a locking lever 50 pivotally connected intermediate its ends to a sleeve 51 that is axially slidable on the outboard end 5' of the handle extension 4' for movement of the locking lever 50 between the fully retracted position shown in FIGS. 9 and 10 to the fully extended position shown in FIG. 11. When thus fully extended, as the thread segments 43 on the extension pole tip 42 are inserted into the grooves or slots 48 in the tool handle socket 47, a locking pin 52 adjacent the forward end of the locking lever 50 will ride up over a ramp 53 either on the outermost end of the tool handle, or in this case on the outermost end of an insert 54 snap fitted inside the tool handle 45 containing the longitudinal grooves or slots 48, and snap into either one of two aligned recesses or holes 55 on opposite sides of the tool handle as shown in FIG. 11 thereby locking the tool handle to the handle extension.

To prevent relative rotation between the handle extension 4' and tool handle 45 when the extension pole tip 42 is fully inserted into the tool handle socket 47, a non-cylindrical shape recess 60 may be provided in the outermost end of the tool handle 45 or tool handle insert 54 for receipt of a correspondingly shaped shoulder 61 on the adaptor 41 adjacent the inner end of the thread segments 43 on the extension pole tip 42 as schematically shown in FIGS. 11 and 12. Because the quick release lock mechanism 40 of this embodiment does not rely on overlapping thread segments on the extension pole tip and tool handle socket to prevent withdrawal of the extension pole tip from the tool handle socket as in the embodiment previously described, the wall segments 62 between the longitudinal grooves or slots 48 in the tool handle socket 47 need not be threaded. This will insure that the thread segments 43 on the extension pole tip 42 remain in the slots in the tool handle socket during insertion of the extension pole tip into the tool handle socket and removal therefrom.

Alternatively, if desired, the threads or thread segments on the extension pole tip of the quick release lock mechanism of the present invention may be collapsed in the quick connect mode and extended in the screw on mode when used with a tool handle having a standard internally threaded socket, in which event the tool handle lock engaging end portion may be substantially the same as that shown in U.S. Pat. No. 5,288,161, the entire disclosure of which is incorporated herein by reference.

Longitudinal movement of the locking lever 50 between its fully extended position shown in FIG. 11 and its fully retracted position shown in FIGS. 9 and 10 may be limited by a pin 62 extending radially through the handle extension 4' and adaptor 41 into a longitudinally extending slot 63 in the inner wall of sleeve 51. The location and length of the slot 63 relative to the pin 62 determine the fully extended and fully retracted positions of the locking lever 50. Pin 62 may also be used to fixedly attach adaptor 41 to handle extension 4'.

The reason for making the locking lever 50 retractable is to make sure it doesn't interfere with threading of the extension pole tip 42 into a standard internally threaded socket of a conventional tool handle. Also when the locking lever 50 is fully retracted, a stop shoulder 65 on the locking lever may drop down behind an axially movable cover slide 66 to maintain the cover slide in its fully extended position shown in FIG. 10 covering the non-cylindrical shoulder 61 on the adaptor 41 to provide an increased friction surface area 67 surrounding the shoulder that is contacted by the outermost end of a tool handle having a standard internally threaded socket when fully tightened onto the extension pole tip 42 to prevent the tool handle from inadvertently coming loose.

On the other hand, when the locking lever 50 is fully extended as shown in FIG. 11, upon engagement of the outer end portion 67 of the cover slide 66 by the outermost end of a tool handle 45 having a compatible lock engaging end portion 46 during insertion of the extension pole tip 42 into the slots or grooves 48 in the tool handle socket 47, the cover slide 66 is easily moved rearwardly against the force of a spring 68 acting on the cover slide to allow the non-cylindrical shoulder 61 on the adaptor 41 to engage the correspondingly shaped recess 60 in the innermost end of the tool handle insert 54 as shown in FIG. 11. The extent of movement of the cover slide 66 between its fully extended and fully retracted positions may be limited by the same pin 62 used to limit the movement of the locking lever sleeve 51 or a different pin extending into a longitudinal groove or slot 69 associated with a cover slide.

Figure 14:
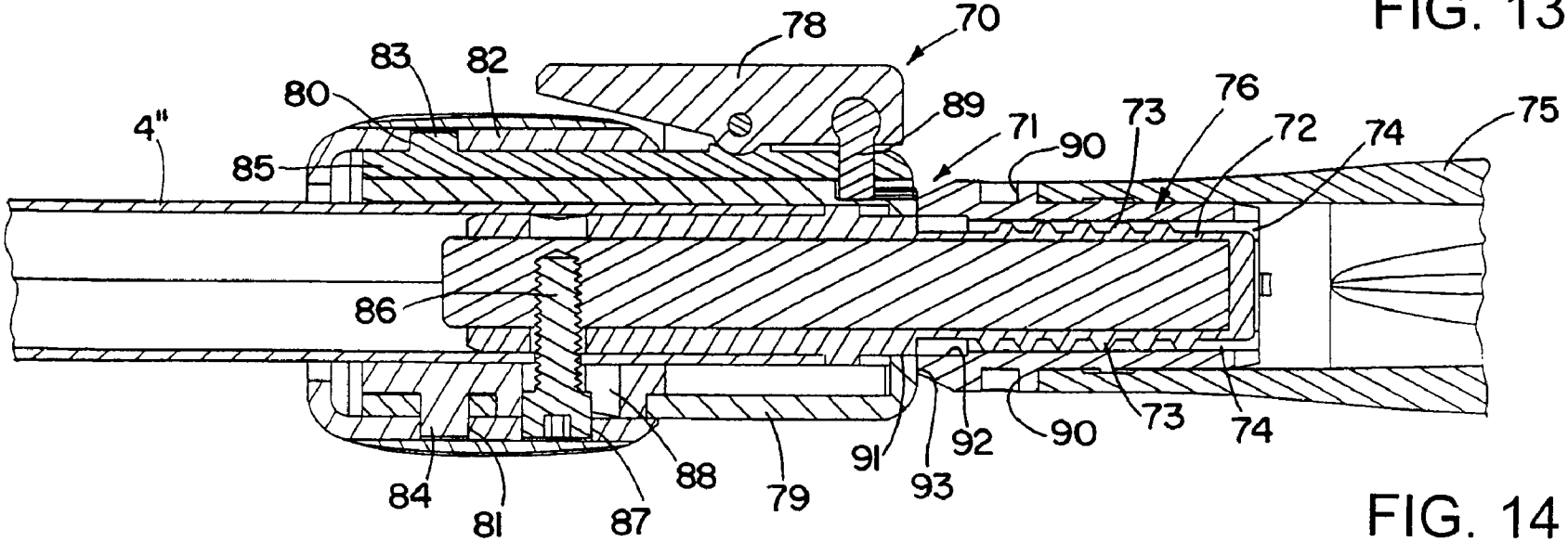
FIG. 14 is a fragmentary longitudinal section through the quick release lock mechanism, handle extension outboard end and compatible tool handle lock engaging end portion of FIG. 13.
Figure 15:
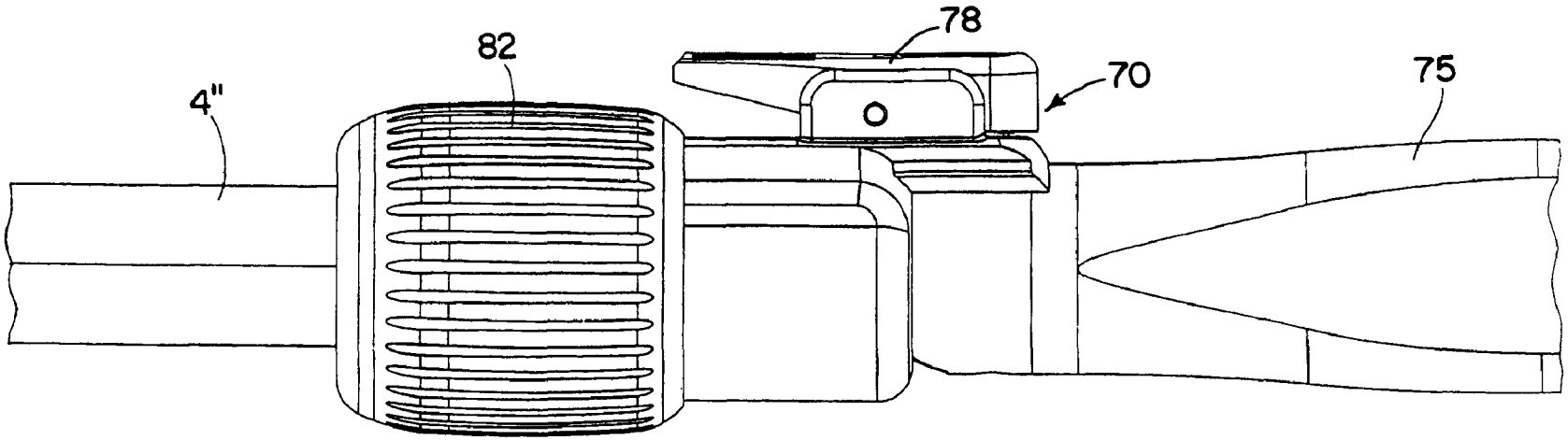
FIG. 15 is a side elevation view similar to FIG. 13 but showing the latch member fully extended and the cover slide fully retracted.
Figure 16:
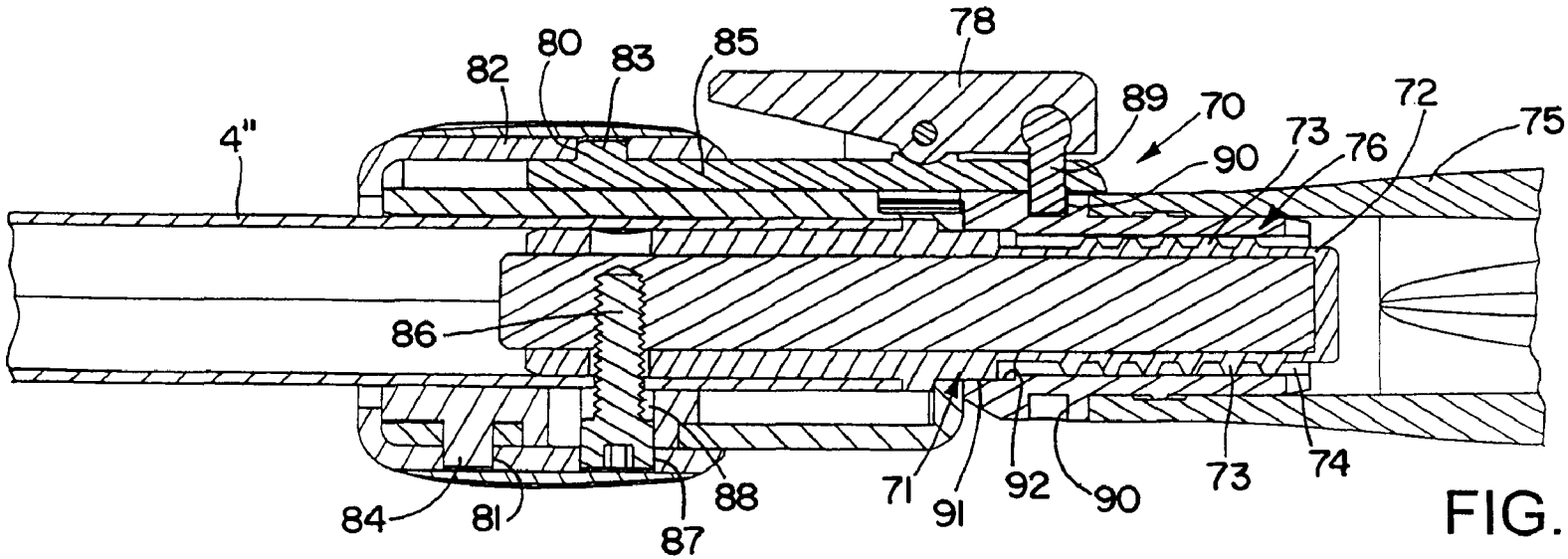
FIG. 16 is a fragmentary longitudinal section through the assembly of FIG. 15.
Figure 17:
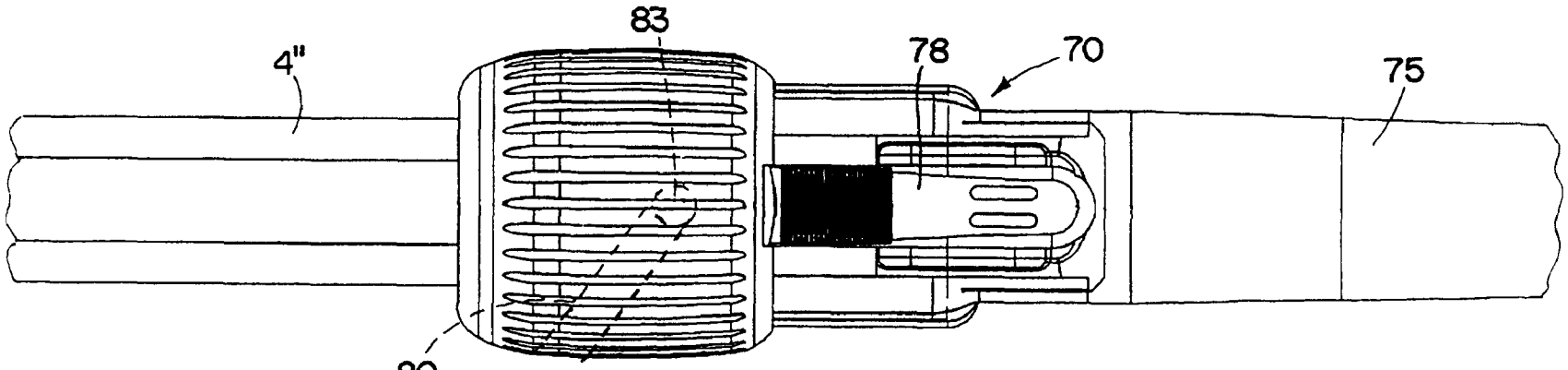
FIG. 17 is a top plan view of the assembly of FIG. 15.
Figure 18:
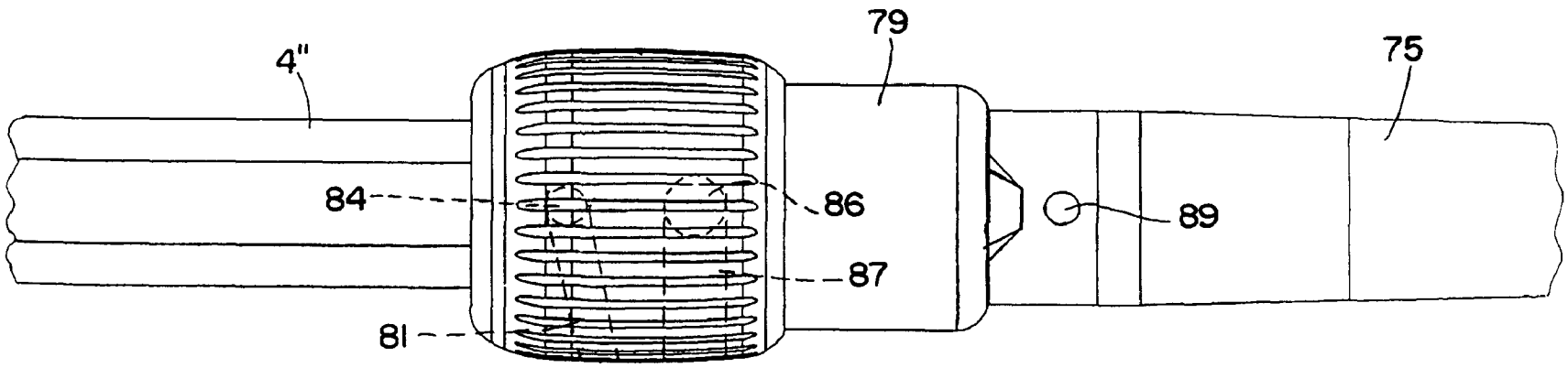
FIG. 18 is a bottom plan view of the assembly of FIG. 15.

FIGS. 13-18 show another form of quick release lock mechanism 70 of the present invention which, like the quick release lock mechanisms previously described, includes an adaptor 71 having an extension pole tip 72 with circumferentially spaced thread segments 73 that may either be quickly and easily inserted into aligned slots or grooves 74 in a compatible tool handle lock engaging end portion 76 as shown in FIGS. 14 and 16 and just as easily removed therefrom or threaded into a standard threaded socket of a conventional tool handle without the need for having to use a special adaptor for that purpose. Also the quick release lock mechanism 70 shown in FIGS. 13-18 includes a locking lever 78 and cover slide 79 that are axially movable between fully extended and fully retracted positions similar to the locking lever 50 and cover slide 66 of the FIGS. 9-12 embodiment.

However, the locking lever 50 shown in FIGS. 9-12 is movable axially back and forth by applying an axial force to the locking lever slide 51 and the cover slide 66 is spring loaded to overlie the non-cylindrical shoulder 61 on the adaptor 41 and is movable rearwardly to expose shoulder 61 by pressing the outermost end of a compatible tool handle lock engaging end portion 46 against the axial outer end of the cover slide.

Movements of the locking lever 78 and cover slide 79 of the quick release lock mechanism 70 of FIGS. 13-18, on the other hand, are controlled by two different cam slots 80, 81 in a rotatable sleeve 82 on the lock mechanism that are engaged by separate pins 83, 84 on the locking lever slide 85 and cover slide 79, respectively, or vice versa. Another pin 86 that extends into a cam slot 87 in the rotatable sleeve 82 to control rotational movements of the rotatable sleeve may also be used to secure the adaptor 71 to the handle extension 4". Pin 86 extends through an axial slot 88 in the cover slide 79 to accommodate axial movements of the cover slide during rotation of the rotatable sleeve.

When the rotatable sleeve 82 is rotated in one direction, the locking lever 78 is extended to allow the locking lever pin 89 to snap into an aligned hole 90 in the tool handle 75 to lock the tool handle to the handle extension 4" and the cover slide 79 is retracted to expose the non-cylindrical shoulder 91 on the adaptor 71 for engagement in a correspondingly shaped recess 92 in the outermost end of the tool handle as shown in FIG. 16. Conversely when the rotatable sleeve 82 is rotated in the opposite direction, the locking lever slide 85 is retracted to move the locking lever 78 out of the way (after the locking lever pin 89 is disengaged from the tool handle hole 90) and the cover slide 79 is extended to overlie the non-cylindrical shoulder 91 as shown in FIG. 14 to provide a larger surface area 93 for frictionally locking a conventional tool handle against loosening when fully tightened onto the extension pole tip 72 as before.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A tool handle including a lock mechanism for releasably connecting handle extensions to tool handles having either compatible lock engaging end portions or standard internally threaded sockets, the lock mechanism comprising an adaptor mounted on an outboard end of a handle extension, the adaptor including an extension pole tip having spaced thread segments circumferentially and axially spaced along the extension pole tip, the extension pole tip being axially insertable into tool handle sockets having compatible lock engaging end portions and being threadably connectable to tool handles having standard internally threaded sockets, the tool handle with the compatible lock engaging end portions having a tool handle socket with circumferentially spaced segments and longitudinal slots or grooves between the circumferentially spaced segments sized for sliding receipt of the circumferentially spaced thread segments on the extension pole tip within the longitudinal slots or grooves during insertion and removal of the extension pole tip into and from the tool handle socket.

2. The tool handle including the lock mechanism of claim 1 wherein the circumferentially spaced segments of the tool handle socket are thread segments that are compatible with the thread segments on the extension pole tip to allow the tool handle to be rotated a part turn relative to the handle extension when the extension pole tip is inserted into the tool handle socket to bring the thread segments of the extension pole tip and tool handle socket into and out of overlapping engagement with each other.

3. The tool handle including the lock mechanism of claim 2 wherein the locking mechanism includes at least one locking tab that is movable into and out of at least one slot on the lock engaging end portion when the thread segments of the extension pole tip and tool handle socket are in overlapping engagement with each other to selectively prevent further relative rotation therebetween.

4. The tool handle including the lock mechanism of claim 3 wherein the locking tab is on a spring loaded sleeve that biases the locking tab into the slot when the thread segments are in overlapping engagement with each other and the locking tab is in alignment with the slot.

5. The tool handle including the lock mechanism of claim 4 wherein a shoulder on the tool handle presses against the locking tab causing the spring loaded sleeve to retract during insertion of the extension pole tip into the tool handle socket until the tool handle is rotated a part turn relative to the handle extension to bring the locking tab into alignment with the slot.

6. The tool handle including the lock mechanism of claim 1 wherein the adaptor and the tool handle have compatible lock engaging end portions that engage one another when the extension pole tip is fully inserted into the tool handle socket to prevent relative rotation therebetween, and a releasable latch prevents the extension pole tip from being withdrawn from the tool handle socket until released.

7. The tool handle including the lock mechanism of claim 6 wherein the tool handle end portion includes a non-cylindrical shape recess that receives a correspondingly shaped non-cylindrical shoulder on the adaptor when the extension pole tip is fully inserted into the tool handle socket to prevent relative rotation between the handle extension and tool handle.

8. The tool handle including the lock mechanism of claim 7 wherein the releasable latch comprises cooperating latch members on the adaptor and tool handle end portion that releasably retain the handle extension and tool handle together when the extension pole tip is fully inserted into the tool handle socket.

9. The tool handle including the lock mechanism of claim 7 wherein the releasable latch comprises a locking lever on the adaptor having a locking pin that is engageable in at least one recess or hole in the tool handle end portion when the extension pole tip is fully inserted into the tool handle socket.

10. The tool handle including the lock mechanism of claim 9 wherein the locking lever is pivotally connected to a locking lever sleeve that is longitudinally slidable between a fully retracted position where the locking lever won't interfere with threading of the extension pole tip into a standard internally threaded socket of a conventional tool handle and a fully extended position for engagement of the locking pin in the at least one recess or hole in the tool handle end portion when the extension pole tip is fully inserted into the tool handle socket.

11. The tool handle including the lock mechanism of claim 10 further comprising a pin extending from the adaptor into a longitudinally extending slot in the locking lever sleeve to limit longitudinal movement of the locking lever between the fully retracted and fully extended positions.

12. The tool handle including the lock mechanism of claim 11 further comprising a longitudinally movable cover slide for covering the non-cylindrical shoulder on the adaptor when the cover slide is fully extended to provide an increased friction surface area surrounding the shoulder that is contacted by an outermost end of a tool handle having a standard internally threaded socket when fully tightened on the extension pole tip to prevent the tool handle from inadvertently coming loose.

13. The tool handle including the lock mechanism of claim 12 further comprising a stop shoulder on the locking lever that drops down behind the cover slide when the locking lever is fully retracted and the cover slide is fully extended to maintain the cover slide in its fully extended position.

14. The tool handle including the lock mechanism of claim 10 further comprising a pin extending from the adaptor into a longitudinal slot in the cover slide for limiting movement of the cover slide between its fully extended and fully retracted positions.

15. The tool handle including the lock mechanism of claim 10 further comprising a longitudinally movable cover slide for covering the non-cylindrical shoulder on the adaptor when the cover slide is fully extended to provide an increased friction surface area surrounding the shoulder that is contacted by an outermost end of a tool handle having a standard internally threaded socket when fully tightened on the extension pole tip to prevent the tool handle from inadvertently coming loose, and a rotatable sleeve on the adaptor having a first cam slot that is engaged by a first cam pin on the locking lever sleeve and a second cam slot that is engaged by a second cam pin on the cover slide for controlling the movements of the locking lever and cover slide between their fully extended and fully retracted positions.

16. The tool handle including the lock mechanism of claim 15 wherein the first cam slot is oriented at a first angle and the second cam slot is oriented at a second angle such that when the rotatable sleeve is rotated in one direction, the locking lever is extended to allow the locking lever pin to engage an aligned recess or hole in the tool handle end portion to lock the tool handle to the handle extension and the cover slide is retracted to expose the non-cylindrical shoulder on the adaptor for engagement in the correspondingly shaped recess in the tool handle end portion, and when the rotatable sleeve is rotated in the opposite direction, the locking lever slide is retracted to move the locking lever out of the way and the cover slide is extended to overlie the non-cylindrical shoulder to provide a larger surface area for frictionally locking a conventional tool handle against inadvertent loosening when fully tightened on the extension pole tip.

17. The tool handle including the lock mechanism of claim 6 wherein the circumferentially spaced segments between the longitudinal slots or grooves of the tool handle socket are non-threaded and have a smaller inner diameter than an outer diameter of the thread segments on the extension pole tip to insure that the thread segments on the extension pole tip remain in the slots or grooves in the tool handle socket during insertion of the extension pole tip into and removal from the tool handle socket.

18. A lock mechanism for releasably connecting handle extensions to tool handles having compatible lock engaging end portions or standard internal threaded sockets, wherein the tool handles that have compatible lock engaging end portions have a tool handle socket with circumferentially spaced segments and longitudinal slots or grooves between the circumferentially spaced segments, the lock mechanism comprising an adaptor mounted on an outboard end of a handle extension, the adaptor including an extension pole tip having spaced thread segment means circumferentially and axially spaced along the extension pole tip, the spaced thread segment means sized for sliding receipt within the longitudinal slots or grooves in the tool handle socket during insertion and removal of the extension pole tip into and from the tool handle socket, the thread segment means also being threadably connectable to tool handles having standard internally threaded sockets.

19. The lock mechanism of claim 18 further comprising means for preventing relative rotation between the adaptor and tool handles having compatible lock engaging end portions when the extension pole tip is fully inserted into the tool handle sockets.

20. The lock mechanism of claim 18 further comprising means for preventing inadvertent pull out of the extension pole tip after insertion into the tool handle sockets having compatible lock engaging end portions.

* * * * *